US012486617B2

(12) United States Patent
Berglund et al.

(10) Patent No.: US 12,486,617 B2
(45) Date of Patent: Dec. 2, 2025

(54) KRAFT PAPER AND PAPER SACK MANUFACTURED THEREFROM

(71) Applicant: Mondi AG, Vienna (AT)

(72) Inventors: Lars Göran Berglund, Sundsvall (SE); Elisabeth Schwaiger, St. Stefan (AT); Rene Van Wieringen, Nijmegen (NL); Leo Arpa, St. Gertraud (AT)

(73) Assignee: Mondi AG, Vienna (AT)

( * ) Notice: Subject to any disclaimer, the term of this patent is extended or adjusted under 35 U.S.C. 154(b) by 646 days.

(21) Appl. No.: 17/762,146

(22) PCT Filed: Sep. 18, 2020

(86) PCT No.: PCT/EP2020/076177
§ 371 (c)(1),
(2) Date: Jul. 11, 2023

(87) PCT Pub. No.: WO2021/053186
PCT Pub. Date: Mar. 25, 2021

(65) Prior Publication Data

US 2024/0026608 A1 Jan. 25, 2024

(30) Foreign Application Priority Data

Sep. 20, 2019 (EP) ..... 19198690

(51) Int. Cl.
*D21H 11/04* (2006.01)
*D21H 15/00* (2006.01)
*D21H 27/10* (2006.01)

(52) U.S. Cl.
CPC ..... *D21H 11/04* (2013.01); *D21H 15/00* (2013.01); *D21H 27/10* (2013.01)

(58) Field of Classification Search
CPC ..... D21H 11/04; D21H 15/00; D21H 27/10; D21H 17/28
See application file for complete search history.

(56) References Cited

U.S. PATENT DOCUMENTS

2024/0026608 A1* 1/2024 Berglund ..... D21H 17/28

FOREIGN PATENT DOCUMENTS

| | | | | |
|---|---|---|---|---|
| CA | 3153632 A1 * | 3/2021 | ..... | D21H 11/04 |
| EP | 3795745 A1 * | 3/2021 | ..... | D21H 11/04 |
| EP | 3795745 B1 * | 10/2024 | ..... | D21H 11/04 |
| FI | 3795745 T3 * | 1/2025 | ..... | D21H 11/04 |
| WO | WO-2021053186 A1 * | 3/2021 | ..... | D21H 11/04 |

OTHER PUBLICATIONS

International Search Report.

* cited by examiner

*Primary Examiner* — Jose A Fortuna
(74) *Attorney, Agent, or Firm* — Dunlap, Bennett & Ludwig

(57) ABSTRACT

A kraft paper having a pulp according to ISO 536 of between 60 g/m$^2$ and 120 g/m$^2$, a density of between 680 kg/m$^3$ and 720 kg/m$^3$, and a tensile strength index in the machine direction according to ISO 1924-3 of between 79 kNm/kg and 98 kNm/kg, the kraft paper optionally having a coating and/or an auxiliary element on at least one side. The kraft paper is made of a pulp having an average pulp fibre length of 2.2 mm to 2.7 mm with a minimum pulp content of at least 96% wt. %; a pore volume of the uncoated kraft paper is between 200 μl/g and 220 ml/g; in the thickness direction of the paper, there are regions of different porosities; and at least one region has pores with a pore diameter of less than or equal to 0.3 μm. The invention also relates to a paper sack.

14 Claims, No Drawings

KRAFT PAPER AND PAPER SACK MANUFACTURED THEREFROM

BACKGROUND OF THE INVENTION

The present invention relates to a kraft paper having pulp according to ISO 536 in the range of from 60 g/m$^2$ to 120 g/m$^2$, in particular from 70 g/m$^2$ to 110 g/m$^2$, a density in the range of from 680 kg/m$^3$ to 720 kg/m$^3$ and a tensile strength index in the machine direction according to ISO 1924-3 of between 79 kNm/kg and 98 kNm/kg, which kraft paper optionally has a coating and/or an auxiliary element on at least one side, and to a paper sack made therefrom.

Kraft papers have been widely used for a large number of years, especially in the packaging sector, and are characterised by a variety of positive properties: in particular, they are stable, relatively tear-resistant, rather insensitive to moisture and, despite these properties, have sufficient air permeability to be used, for example, as sacks for building materials, foodstuffs and the like. In addition, kraft paper in particular has the advantage over many other types of paper currently in use that, with the exception of a few additives, it is a natural material that can be reused, recycled or, if it does not contain other components such as plastic coatings and the like, can also be composted. Kraft paper is usually produced with a very high content of pulp. In addition to pulp, all the usual additives such as starch and sizing are contained in the kraft paper. Due to its high strength, kraft paper is mainly used in industrial applications for sacks such as cement sacks, sand sacks and the like.

A reinforced, porous fibre product has already become known from WO 2009/112635 A1, in which filler particles are introduced between the fibres.

WO 2015/035434 A1 describes a water-soluble sack paper which, in addition to auxiliary substances such as surfactants, contains in particular long-fibre softwood fibres.

EP 1 818 451 A1 describes a wrapping paper and a paper sack produced therefrom, which have at least in part a network structure and discrete island areas enclosed by the network structure, which paper has a higher porosity at a given strength.

EP 3 184 296 A1 describes a multi-ply paper sack in which a plastics film is inserted between two paper layers and which sack is hydrophobic.

Due to the favourable properties of products made from kraft paper, there is a need to further develop kraft papers so that, within the next five to ten years, currently used plastic packaging and plastic-coated kraft papers could be substantially replaced by alternatives made from papers without any plastic content, in order to ensure that packaging made from them is almost completely recyclable.

However, in order for a kraft paper to be fully recyclable, it is necessary that it does not have any plastic coatings or plastic inserts or other non-decomposable components, as is common, for example, for papers that come into contact with moisture. Packaging materials without plastic linings or coatings, in addition to requirements such as having sufficient air permeability, for example to allow air to escape during their filling, must also have sufficient elasticity, for example not to tear when filled with materials having a high specific weight, such as cement, due to the moulding or deformation that acts on the paper when a sack is set down or subjected to pressure or dropped.

Furthermore, kraft papers are increasingly used as shopping bags or refuse sacks in order to replace non-recyclable plastic sacks or non-compostable plastic sacks with "natural materials" as far as possible. However, paper sacks currently in use have the disadvantage that, on the one hand, they are not compostable or not biodegradable due to linings that are currently not yet dispensable or, on the other hand, if such coatings are not present, they are not sufficiently stable not to tear immediately in the case of unexpected loads or if objects having rough edges are contained in them.

There is therefore a need for a kraft paper that is on the one hand sufficiently stable to withstand even greater loads, both in terms of weight and pressure loads and stresses, and on the other hand also at the same time has a certain moisture stability so that it does not tear immediately after becoming damp or wet.

SUMMARY OF THE INVENTION The invention now aims to provide a kraft paper which is sufficiently stable not to tear under stress, the wet strength of which paper is such that tearing is not to be feared even when filled with moist materials and which is also completely decomposable without the use of undesirable coatings.

To solve this problem, a kraft paper according to the present invention is substantially characterised in that the kraft paper is formed from a pulp having an average fibre length of the pulp of from 2.2 mm to 2.7 mm with a minimum content of pulp in the kraft paper of at least 96 wt. %, preferably at least 97 wt. %, and in that a pore volume of the uncoated kraft paper measured by mercury porosimetry according to ISO 15901-1 is from 200 μl/g to 220 ml/g, in that in the thickness direction of the paper there are formed regions of different porosity from one another measured by mercury porosimetry according to ISO 15901-1, and in that at least one region has pores with a pore diameter less than or equal to 0.3 μm. Such kraft paper, due to the fact that it has an extremely high pulp content of at least 96 wt. % and due to the fact that no coating is provided, can be both easily recycled as well as composted, and furthermore, due to the special design with a pore volume between 200 μl/g and 220 ml/g, has a sufficient gas permeability for a quick filling of a sack produced therefrom while at the same time the paper has stability to accommodate even heavy, bulky and moist objects in the paper without unintentionally tearing or being destroyed. Furthermore, such paper is 100% decomposable due to an extremely high pulp content and the fact that it is free from a coating. Furthermore, by forming regions in the thickness direction of the paper of different porosity from one another measured by mercury porosimetry according to ISO 15901-1, it is possible to form a paper that has a changing property in its thickness direction. Thus, the porosity on one surface can be significantly smaller compared to the other surface, which on the one hand is favoured by the production process, in which on the wire side of the paper there is usually a higher accumulation of shorter fibre components and thus a lower porosity is formed than on the side facing away from the wire. However, such a porosity gradient is also dependent on other factors and can be controlled, which makes it possible to produce a paper that on the one hand has excellent porosities and on the other hand, however, is easily printable. In particular, the side with the lower porosity according to ISO 15901-1 is subsequently selected as the side to be printed. Thus, using standard printing processes, such as flexographic printing, inkjet printing or the like, it is possible to reliably print on the kraft paper without the printing inks fading or running. By forming the kraft paper from a pulp of which the average fibre length is between 2.3 mm and 2.6 mm, it is possible to produce a paper which is strong enough to withstand handling, transport and pressure, for example in refuse collection plants, without a sack formed therefrom tearing, and yet, on the other hand, is safely compostable within a normal composting period.

In order to be able to use such a kraft paper for household applications, in particular for example as refuse sacks, it is substantially further developed in that the at least one coating and/or the at least one auxiliary element applied on at least one side is selected from the group of markings such as optical markings, UV markings, indicators such as an indicator dye, sensors such as a sensor ink and chemically or physically processed surface regions such as viewing windows. By providing a coating and/or at least one auxiliary element which is applied to at least one side of the kraft paper, it is possible to provide markings, texts, viewing windows, adhesive elements or aids for gluing, etc. on the paper in order to subsequently be able to distinguish the paper from other papers, for example on the basis of the text, markings, colour markings, fluorescent markings, etc. applied to it, or to be able to reliably transport or close a sack formed from such a paper or to be able to detect the contents. Markings in this context are, for example, patterns, labelling and the like that can be excited by means of UV light. Indicators and sensors are elements which either show a colour different from the original colour after excitation and thus enable differentiation or detection of substances contained in the packaging for example. Sensors can also detect oxygen, nitrogen, amines or such substances and change colour after contact with these substances, for example, in order to be able to detect goods or waste wrapped in the paper. Similarly, such markings, indicators or sensors can be thermally excitable. If a chemical reaction takes place inside a sack formed from the kraft paper, which reaction is exothermic for example, such markings, sensors or indicators can change colour. In this context, viewing window are understood to mean a region of the paper which becomes translucent due to chemical and/or physical treatment, so that the contents or the material or substances present behind this viewing window can be identified. This can happen, for example, by applying biomolecular alcohol or the like.

In the context of the present application, a coating means any material applied to the surface of a kraft paper according to the present invention, such as inks, dyes, rubber coatings or the like. A coating may extend here only over a small portion of the surface of the paper or may cover up to 50% of the surface. A coating according to the present invention differs fundamentally from additional layers of, for example, plastic material applied over the entire surface, as was common in the prior art, but always affects only a region of the surface of the paper and does not change the properties, such as tear resistance, water solubility or air permeability, of the paper and/or the sack produced therefrom, or only changes them very slightly.

According to a further development of the invention, the kraft paper is formed in such a way that the regions of porosity different from one another in the thickness direction of the paper as measured by mercury porosimetry according to ISO 15901-1 are layers that merge into one another. By forming the kraft paper with regions or layers of porosity different from one another in the thickness direction as measured by mercury porosimetry according to ISO 15901-1, it is possible to form a paper that has a changing property in its thickness direction. Thus, the porosity on one surface can be significantly smaller compared to the other surface, which on the one hand is favoured by the production process, in which on the wire side of the paper there is usually a higher accumulation of shorter fibre components and thus a lower porosity is formed than on the side facing away from the wire. However, such a porosity gradient is also dependent on other factors and can be controlled, which makes it possible to produce a paper that on the one hand has excellent porosities and on the other hand, however, is easily printable. In particular, the side with the lower porosity according to ISO 15901-1 is subsequently selected as the side to be printed. Thus, it is possible to reliably print on the kraft paper using standard printing processes, such as flexographic printing, inkjet printing or the like, without the printing inks fading or running. In accordance with a further development of the invention, in which the regions of different porosity present in the thickness direction of the paper are in the form of regions or layers of different porosity measured by mercury porosimetry according to ISO 15901-1 that merge into one another, it is furthermore possible to avoid the formation of interfaces inside the paper and to avoid detachment of individual layers from each other. The same applies if the layers that merge into one another are formed, for example, in the longitudinal or transverse direction of the paper.

For good printability, in particular for a possibility to be able to distinguish paper sacks from each other based on a design incorporated in the surface thereof, the invention is further developed such that at least one region has pores with a pore diameter smaller than or equal to 0.01 μm to smaller than 0.3 μm and such that an average value of the porosity of said region or said regions is smaller than or equal to 5.5 μl/g measured by mercury porosimetry according to ISO 15901-1. By forming a layer with an extremely small porosity, the kraft paper can be printed well without excessive ink consumption and without fear of the inks running and bleeding.

Furthermore, already by forming the paper with a gradient of pore volume, with one side having such a low porosity, a significantly increased moisture stability can surprisingly be achieved, whereby a tearing of the paper, for example when used as a refuse sack for moist, compostable waste, can be prevented.

By forming the kraft paper from a pulp of which the average fibre length is between 2.2 mm and 2.7 mm, in particular between 2.3 mm and 2.6 mm, it is possible to produce a paper which is strong enough to withstand handling, transport and pressure, for example in refuse collection plants, without a sack formed therefrom tearing and, on the other hand, is safely compostable within a usual composting period. By choosing pulp with such fibre lengths, which usually comes from softwoods, it is possible to provide a relatively easily and quickly biodegradable paper. It has been shown here that the more homogeneous the average fibre length, i.e. the smaller the difference in the length of the fibres contained in the pulp, the more favourable its properties become with regard to the biodegradation of the paper.

In accordance with a further development of the invention, in which the kraft paper is made to be water-repellent by sizing and has a water absorption value $Cobb_{60}$ according to ISO 535 of between 14 g/m$^2$ and 21 g/m$^2$, it is even better suited for use in the packaging and disposal of moist organic and biodegradable products, such as organic waste and organic household waste, since the low water absorption value makes it possible to ensure that the paper will not tear or be prematurely destroyed even during prolonged storage of moist organic waste in a sack made of this paper. Furthermore, such a paper or a sack produced from this paper can subsequently be used also in composting presses, waste sorting plants, etc. without tearing due to the moisture of the material contained therein and contaminating the plants. For further improved water resistance, the kraft paper can be finished with polymeric wet strength agents, as is the case in accordance with a further development of the invention.

In accordance with a further development of the invention, an optical marking, UV marking, indicator dye or sensor ink is applied to the paper as an auxiliary element. With such an auxiliary element, it is not only possible to mark the paper, but also, for example, to print special patterns, colourings, colourings or patterns visible in ultraviolet light onto the paper, so that subsequently a waste separation plant is able, for example, to sort out sacks from the waste stream which have a sought-after pattern in UV light, and in this way, for example, biodegradable waste can be sorted out from the waste stream. Other markings can be, for example, indicator dyes which form a colour reaction due to reactions with the contents of a sack formed from such a paper, and thus a waste separation plant is able to recognise that such a refuse sack contains, for example, organic waste, oil or the like.

In this context, it should be noted that colour pigments that emit different colours when excited with UV light are preferably used, for example, to distinguish for example also between different wastes. Examples of such colours are blue with a peak wavelength of 449 nm, green with a peak wavelength of 526 nm, orange with a peak wavelength of 584 nm and red with a peak wavelength of 618 nm. Such inks or pigments can be produced in a conventional manner as known to a person skilled in the art in this field.

In accordance with a further development of the invention, in which the kraft paper is designed in such a way that a translucent region, in particular a viewing window, is provided as an auxiliary element, paper can be produced or provided which, when used for example as a refuse sack or shopping sack, enables the user to recognise the contents from the outside without having to open the sack again. Such a viewing window can also be helpful in refuse sorting plants or waste sorting plants in order to be able to detect the contents of the sacks and thus, for example, sort out sacks according to their contents or send them for final recycling.

Due to the ever-increasing demand for compostable or decomposable materials, and in particular the attempt to avoid non-decomposable or non-recyclable plastics as far as possible, it is a further aim of the present invention to provide a paper sack which is 100% recyclable and also 100% compostable, so that it can be used for example in biogas plants or in composting plants and can be used sustainably.

To solve this problem, the paper sack according to the invention is substantially characterised in that it is formed with a closure element at its upper free edge region and in that the closure element consists of a closure band made of paper or other decomposable materials or is formed of a closure region provided with an adhesive. By forming the paper sack with a closure element at its upper free edge region, which closure element is formed from, for example, a closure band or a closure region provided with an adhesive, such a paper sack can be closed after its filling when used as a refuse sack without the contents escaping and can subsequently be further processed in composting plants or refuse separation plants.

In contrast to conventional adhesives or adhesive tapes, a biodegradable adhesive is used as adhesive and is selected from the group of natural glues, dextrin, and water-based biodegradable adhesives and the like. With the help of such an adhesive, it is further ensured that undesirable organic adhesive residues remain during composting or that toxic gases, which may result from the polymer adhesive, are formed during incineration.

For secure gluing of such a paper sack, the paper sack is further designed such that an adhesive is applied to the paper on at least one side in the upper region. In this way, the sack can be closed, for example, by gluing the upper edges tightly together, thus preventing the contents of the sack from escaping, or a flap can be provided, whereby additional strength is achieved in the upper edge region of the sack.

In accordance with a further development of the invention, in which the paper sack is further developed in such a way that it is provided on an outwardly directed surface with an auxiliary element selected from the group of markings such as optical markings, UV markings, indicators such as an indicator dye, sensors such as a sensor ink and chemically or physically processed surface regions such as viewing windows, it is possible to sort out such sacks in, for example, a sorting plant on the basis of their auxiliary element or to feed them for sorting or separate processing.

In order to ensure that the marking can be detected even if, for example, a large number of sacks are being transported or if they are crumpled, soiled or the like, the invention is further developed in that the auxiliary element is a UV marking and in that the marking is provided on at least 20%, preferably at least 25%, but less than 70% of the surface of the sack. Here, in addition to the fact that, as explained above, various markings excitable with UV light, with detector dyes or the like are used, it is of course also possible to apply a very specific pattern, for example to enable a sorting plant to separate organic waste from non-organic waste.

In order to ensure reliable reading or detection of a sack marked in this way, the invention is further developed in that the marking is formed from a fluorescent ink with a pigment concentration of greater than 0.3%, in particular greater than 0.35%. Excessively low pigment concentrations can lead here to the fact that, in particular if a sack is to be sorted out from a large number of sacks, even in a dirty environment, it cannot be detected due to dirt residues on its surface. For this reason, the pigment concentration must be greater than 0.3%. In addition, the area to which the pigments are applied must be greater than at least 25% of the total surface area of the objects, again to ensure that a reader in a waste sorting plant can sort out the appropriately marked sacks with certainty.

The marking with a fluorescent ink can be applied here, for example, during the manufacturing process of the paper, for example it can be applied in the Clupak system with the help of a spraying device, wherein it has proven to be favourable that at least 20% of the surface is wetted with indicator ink, wherein any pattern can be selected here.

EXAMPLE OF THE INVENTION

The invention is explained in more detail below with reference to an example for producing a refuse sack according to the invention.

For this purpose, a Clupak paper is produced in the conventional manner, in which a spraying device is additionally provided in the Clupak system and applies a pattern consisting of bars and lines, which lines substantially have a width of several centimetres, to the wire side of the paper. The lines are selected here in such a way that they are not covered by the paper flap, which is folded over the opening and glued during the course of closing the sack.

Such a paper is used to make a single-layer refuse sack with a stand-up bottom of about 10 cm in width and a capacity of 140 l. The paper has a pulp of 90 g/m$^2$, a density of 700 kg/m$^3$, a tensile strength index in the machine direction of 85 kNm/kg, an air resistance according to Gurley of 25 s and a pore volume of the base paper of 210 ml/g. The sack is formed with a flap which has a dextrin adhesive layer applied to one side, which only becomes adhesive by wetting and is subsequently firmly bonded to the underlying paper after the flap has been folded over, in order to prevent any unintentional leakage of objects contained therein.

In the lower region directed towards the stand-up bottom, a marking visible in UV light in the form of a grid is applied over the circumference of the paper sack, wherein the marking has a bar width of about 4 cm. The indicator colour was applied here in a concentration of 0.40% pigment concentration and a diamond or bar pattern fluorescing yellow in UV light was formed.

After producing such refuse sacks, one such refuse sack was filled with green waste for test purposes, one refuse sack was filled with household waste, wherein organic waste and non-organic waste, and lastly, in a third case, it was filled with differently biodegradable or decomposable household waste.

All sacks were sealed by moistening the adhesive layer and gluing the flap.

During a test in a waste sorting plant, all bags produced in this way were detected by the UV reader of the sorting plant and subsequently sorted out of the system. All three sacks were in tact after being sorted out. The correct sacks were sorted out of the waste stream and subsequently deposited at a composting plant to be able to observe the composting of the contents and the sack.

After three months in the composting plant with a permanent supply of moisture and the use of a rapid composting agent, it was found that the sacks, which were 100% in tact after sorting, were now completely rotted and residues of the paper could no longer be found in the compost.

The invention claimed is:

1. A Kraft paper having a grammage according to ISO 536 in the range from 60 g/m$^2$ to 120 g/m$^2$, a density in the range from 680 kg/m$^3$ to 720 kg/m$^3$ and a tensile strength index in the machine direction according to ISO 1924-3 between 79 kNm/kg and 98 kNm/kg, which kraft paper has a coating and/or an auxiliary element on at least one side, wherein the kraft paper is made from a pulp with an average fibre length of the pulp of from 2.2 mm to 2.7 mm with a minimum content of pulp in the kraft paper of at least 96 wt. %, and a pore volume of the uncoated kraft paper measured by mercury porosimetry according to ISO 15901-1 is from 200 μl/g to 220 ml/g, in the thickness direction of the paper, there are formed regions of different porosity from one another measured by mercury porosimetry according to ISO 15901-1, and at least one region has pores with a pore diameter less than or equal to 0.3 μm.

2. The kraft paper according to claim 1, wherein the at least one coating and/or the at least one auxiliary element applied to at least one-side is/are selected from optical markings, or UV markings, an indicator dye, a sensor ink, chemically or physically processed surface region which are viewing windows.

3. The kraft paper according to claim 2, wherein the viewing window, is provided as an auxiliary element.

4. The kraft paper according to claim 1 wherein the regions of different porosity in the thickness direction of the paper, measured by mercury porosimetry according to ISO 15901-1, are merged layer each with different regions of porosity.

5. The kraft paper according to claim 1, wherein at least one formed region of different porosity has pores with a pore diameter smaller than or equal to 0.01 μm to smaller than 0.3 μm, and in that an average value of the pore volumes of this formed region or these formed regions is smaller than or equal to 5.5 μl/g measured by mercury porosimetry according to ISO 15901-1.

6. The kraft paper according to claim 1, wherein a mean fibre length of the pulp is from 2.3 to 2.6 mm.

7. The kraft paper according to claim 1, wherein the kraft paper air resistance (Gurley) is greater than 20 sec and less than 40 sec.

8. The kraft paper according to claim 1, wherein the kraft paper is made water-repellent by sizing and has a water absorption value $Cobb_{60}$ according to ISO 535 of between 14 g/m$^2$ and 21 g/m$^2$.

9. A paper sack made of the kraft paper according to claim 1, wherein the paper sack is formed with a closure element at its upper free edge region, and the closure element consists of a closure band or a closure region provided with an adhesive.

10. The paper sack made of the kraft paper according to claim 9, wherein the paper sack formed with an upper edge region provided at least partially with an adhesive on one side or is formed with a flap provided at least partially with an adhesive.

11. The paper sack according to claim 9, wherein the adhesive is biodegradable and is selected from the group of natural glues, dextrin, and water-based biodegradable adhesives.

12. The paper sack according to claim 9, wherein the paper sack has applied to an outwardly directed surface, an auxiliary element selected from the optical markings or UV markings, an indicator dye, a sensor ink, chemically or physically processed surface regions which are viewing windows.

13. The paper sack according to claim 12, wherein the auxiliary element is a UV marking, on at least 20%, of the surface of the sack.

14. The paper sack according to claim 12, wherein the auxiliary element is formed from a fluorescent ink with a pigment concentration of greater than 0.3%.

* * * * *